United States Patent [19]

Molyneux

[11] Patent Number: 4,967,955

[45] Date of Patent: Nov. 6, 1990

[54] RAIL ANCHORAGE ARRANGEMENT

[76] Inventor: Godfrey M. O. Molyneux, "Burway", Rudford, Gloucester GL2 8DY, England

[21] Appl. No.: 377,162

[22] Filed: Jul. 7, 1989

Related U.S. Application Data

[63] Continuation-in-part of Ser. No. 107,384, Oct. 9, 1987, abandoned.

[30] Foreign Application Priority Data

Oct. 13, 1986 [GB] United Kingdom ..... 8624466

[51] Int. Cl.[5] ..... E01B 9/00; E01B 13/00

[52] U.S. Cl. ..... 238/311; 238/317; 238/377

[58] Field of Search ..... 238/106, 282, 310, 311, 238/315, 317, 321, 322, 332, 335, 336, 341, 342, 343, 377

[56] References Cited

U.S. PATENT DOCUMENTS 4,821,957 4/1989 Molyneux ..... 238/317

*Primary Examiner*—Joseph F. Peters, Jr.
*Assistant Examiner*—Virna Lissi Mojica
*Attorney, Agent, or Firm*—Marshall, O'Toole, Gerstein, Murray & Bicknell

[57] ABSTRACT

A rail anchorage arrangement for fastening a rail, the anchorage comprises: a support structure; a body of weldable material welded to the upper surface of the support structure at a weld between the body and the support structure extending at least partially around the body and along at least 20% of the length of the body from said upper surface of the support structure; a screw-threaded hole extending into the body of weldable material from the end thereof remote from said upper surface of the support structure; a screw-threaded member screwed into the screw-threaded hole so as to be made fast in the body of weldable material, this member not being threaded into the support structure; a rail anchorage having a hole receiving the screw-threaded member so that the screw-threaded member makes fast the rail anchorage against said upper surface of the support structure to secure a rail to the support structure; the body having a lateral dimension which is at least 40% greater than the outer dimension of the thread of the screw-threaded member so that the body and the weld serve to resist substantially all lateral forces between the rail anchorage and the support structure. By the provision of the body of weldable material the screw-threaded member does not have to be of weldable material and hence can be a high strength material.

9 Claims, 4 Drawing Sheets

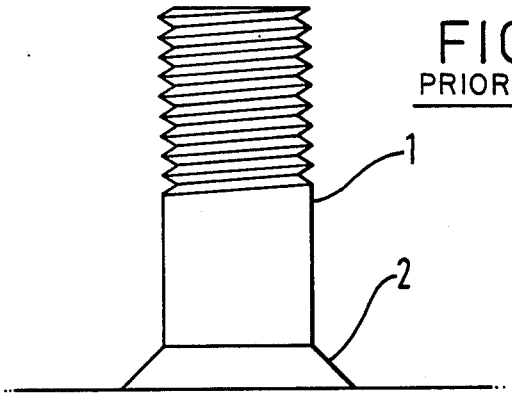
FIG. 1.
PRIOR ART
FIG. 2.
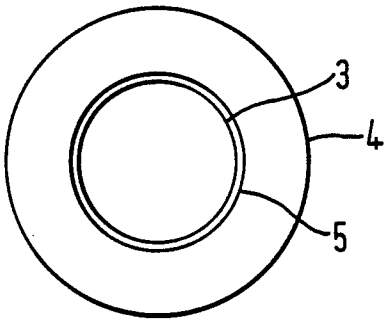
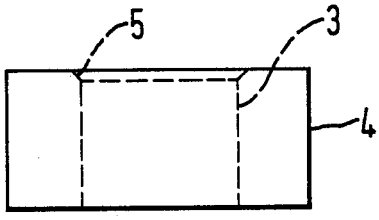
FIG. 2A.
FIG. 9.
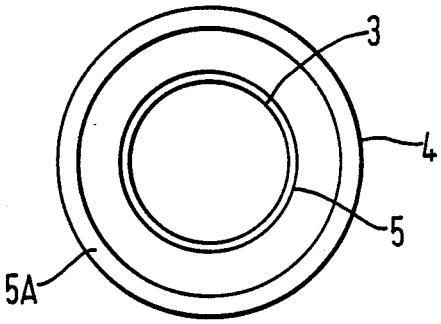
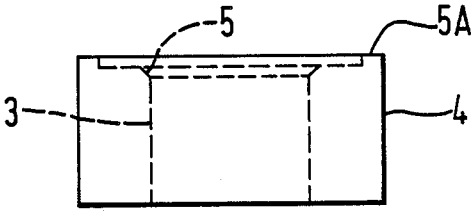
FIG. 9A.

RAIL ANCHORAGE ARRANGEMENT

RELATED APPLICATION

This application is a Continuation-In-Part of pending application Ser. No. 07/107,384 filed Oct. 9, 1987 now abandoned.

FIELD AND BACKGROUND OF THE INVENTION

This invention relates to a rail anchorage arrangement that is for fastening a rail. All rails are anchored but the invention is particularly concerned with an anchorage arrangement for rails used by cranes. These rails transfer heavy lateral forces to their anchorages and the anchorages must transfer the heavy lateral forces to a fastening device which is secured to a support structure.

As shown in FIG. 1 of the accompanying drawings, which is a side view, a prior art fastening device is a metal bar 1 screw-threaded at one end and welded at its other end, at 2, to the support structure upon which the rail anchorage is to rest. This allows only a small amount of weld in relation to the cross-sectional area of the screw-threaded part of the bar and limits the material of the bar to being a standard weldable metal.

Reference is also made to U.S. Pat. No. 3,758,032 to Varga et al. Therein is disclosed a rail anchorage arrangement in which there is a baseplate secured to a foundation. A threaded boss or ferule is fitted to this baseplate by welding or is a press fit therein. A bolt passed through an aperture in a rail clip and threaded into the boss or ferule secures the rail clip to the baseplate. The rail clip has heel lugs symmetrically spaced about its bolt-receiving aperture. These lugs are received in recesses in the baseplate. It is these lugs in co-operation with the recesses in which they are received which provide lateral stability and the boss or ferule plays no part in this. Accordingly, the boss or ferule is thin walled whereas according to standard engineering design a nut (which the part of the boss or ferule above the baseplate effectively is) has to be at least 30% larger in diameter than the diameter of the bolt it receives to withstand tensile or lateral loading equivalent to the strength of the bolt.

The purpose of the invention is to provide an efficient and economical means of providing a body of weldable material that is a fastening device to locate a rail anchorage using a standard screw-threaded high strength bar or bolt. Since it is difficult to weld a high strength bar without destroying its strength characteristics, the invention provides a means whereby such a bar can be efficiently attached to a weld which can match the strength of the high strength bar. The invention also provides an increased amount of weld area which is advantageous when construction site welding is not of a reliable standard, enabling a standard strength screw-threaded bar to be used efficiently.

It is possible to protect screw threads of the body of weldable material of the invention that receive the screw-threaded bar or bolt beneath the rail anchorage so that the body can be re-used if re-installation is required after several years.

SUMMARY OF THE INVENTION

This invention provides a rail anchorage arrangement for fastening a rail, the anchorage comprising:

a support structure;

a body of weldable material welded to the upper surface of the support structure at a weld between the body and the support structure extending at least partially around the body and along at least 20% of the length of the body from said upper surface of the support structure;

a screw-threaded hole extending into the body of weldable material from the end thereof remote from said upper surface of the support structure;

a screw-threaded member screwed into the screw-threaded hole so as to be made fast in the body of weldable material, this member not being threaded into the support structure;

a rail anchorage having a hole receiving the screw-threaded member so that the screw-threaded member makes fast the rail anchorage against said upper surface of the support structure to secure a rail to the support structure;

the body having a lateral dimension which is at least 40% greater than the outer dimension of the thread of the screw-threaded member so that the body and the weld serve to resist substantially all lateral forces between the rail anchorage and the support structure.

In the present rail anchorage arrangement, the screw-threaded member can be a screw-threaded bar which receives a washer and nut which press down toward the rail anchorage when the nut is tightened and thus a rail flange trapped between the anchorage and the support structure is secured. Alternatively the screw-threaded member can be a bolt that is tightened down onto the rail anchorage. Lateral loads from the secured rail are transferred via the rail flange to the rail anchorage. The load then passes through the rail anchorage to the screw-threaded member, then to the body of weldable material and finally to the support structure to which the body is welded.

The invention not only allows more weld for supporting the screw-threaded member than the prior art. By the invention the screw-threaded member is supported by the body of weldable material high up close to the load transfer point of the rail anchorage, thus reducing the tendency of the screw-threaded member to bend as a result of lateral loading from the rail anchorage. As the lateral loads are taken by the body of weldable material it is sufficient for the rail anchorage and the support structure to be in a substantially planar face-to-face engagement that does not have to resist lateral forces. Thus no complicated interengaging structure has to be provided as between the anchorage and the support structure.

BRIEF DESCRIPTION OF THE DRAWINGS

The invention will be better understood from the following detailed description taken in conjunction with the accompanying drawings wherein:

FIG. 1 is a side view showing a prior art fastening device;

FIG. 2 is a plan view of a body of weldable material, in accordance with the invention, for a rail anchorage fastener for fastening a rail (in particular a rail for use by a crane) to a support structure;

FIG. 2A is a side view of the body of FIG. 2;

FIG. 9 is a plan view of an alternative body of weldable material in accordance with the invention; and FIG. 9A is a side view of the body of FIG. 9.

DETAILED DESCRIPTION OF THE DRAWINGS

Figure 3:
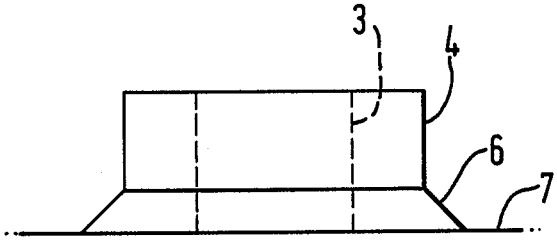
FIG. 3 is a side view of the body of FIGS. 2 and 2A shown welded to a support surface.
Figure 4:
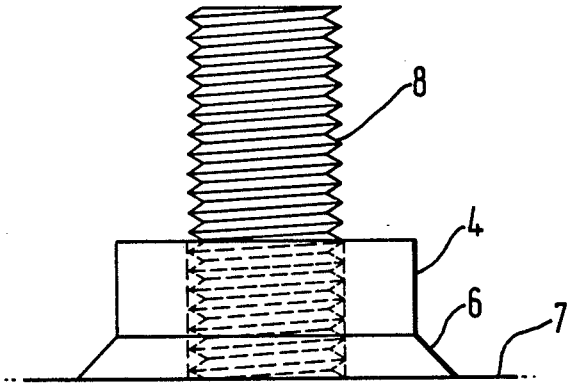
FIG. 4 is a side view of the body as shown in FIG. 3 but with a screw-threaded bar screwed into the body.

FIG. 1 has already been described.

Referring to FIGS. 2, 2A, 3 and 4, the body of weldable material 4 is a is a circular billet which has a screw-threaded hole 3 to receive a screw-threaded bar 8. In use the body 4 is welded, at 6, to a support structure 7 that is generally a steel beam which also supports the crane rail. The weld 6 extends at least partially around the body 4 and does not directly cross the plane of stress of the supporting steel beam. In order to protect the threads from penetration of the weld material and from its heat affected zone, the outside diameter of the body 4 is at a minimum 40% greater than the diameter (that is the outer dimension of the thread) of the bar 8. For example, for a $\frac{7}{8}''$ diameter bolt, the minimum outside diameter of the body 4 would be 1.225" and is, in practice, $1\frac{3}{8}''$ diameter (or approximately 50% greater than the bolt diameter).

Figure 5:
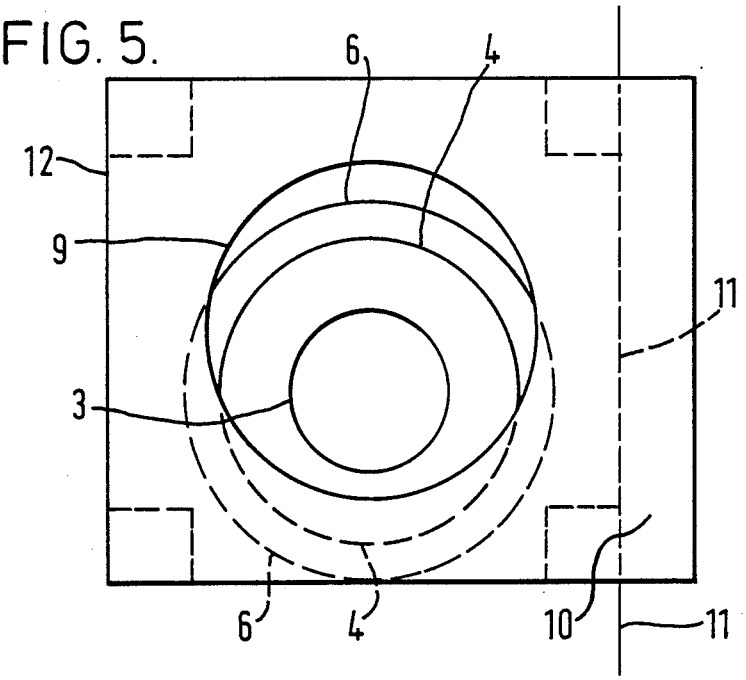
FIG. 5 is a plan view showing a rail anchorage in position over the body welded to the support structure.
Figure 6:
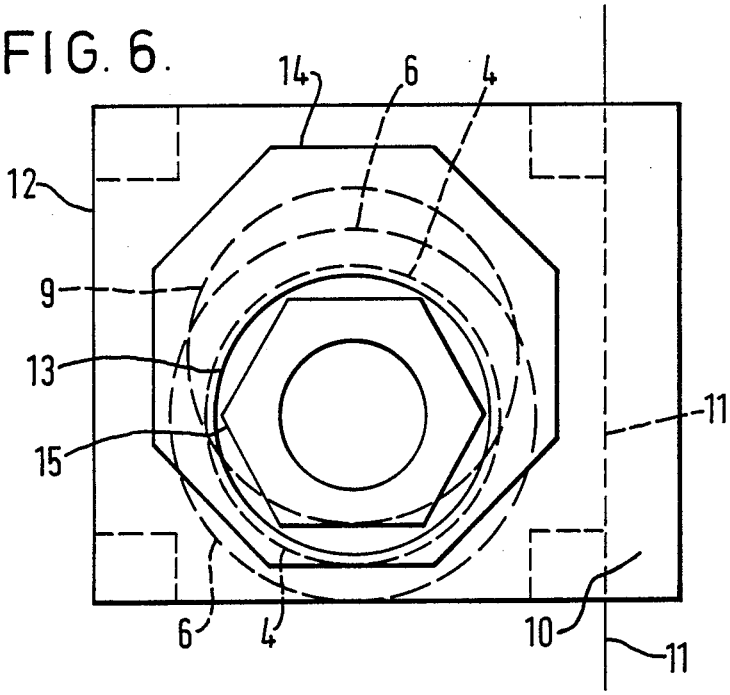
FIG. 6 is a plan view showing the rail anchorage in position over the body as in FIG. 5 but with a screw-threaded bar, rotatable cam, washer and nut assembled in position in relation to the rail anchorage.
Figure 7:
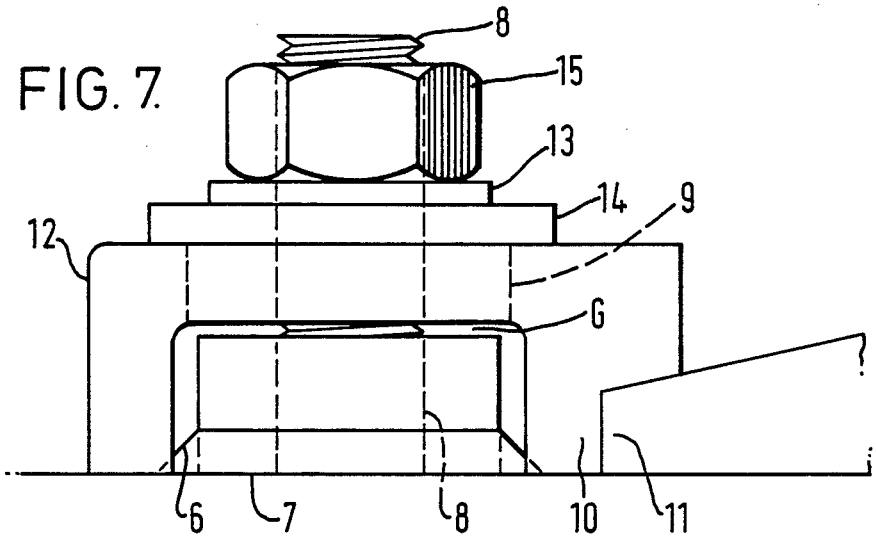
FIG. 7 is a side view of the assembled components shown in FIG. 6.

As shown in FIGS. 5 to 7, the body 12 of the rail anchorage is fitted over the body 4 of weldable material and rests on the supporting structure 7. The body 12 is apertured so that the screw-threaded bar 8 can be passed through the body 12 and screwed into the body 4 of weldable material below.

Because the threads in the body 4 have not been affected by the welding (as discussed above) the bar 8 can be screwed into the body 4 all the way to the upper surface of the structure 7 and so that the lower end portion of the bar 8 is within the welded area. As the formation of the weld does not affect the threads, the weld can be taken some way up the body 4, to 20% or more of the height of the body 4, and thus a significant extent of the bar 8 is within the weld. As the body 4 has its diameter at least 40% greater than that of the bar 8, and as the weld extends over at least 20% of the height of the body, substantially all lateral forces from the rail, in use, are opposed by the body 4. Thus, the engagement between the rail anchorage 12 and the support structure 7 can be, and to simplify construction is, a substantially planar face-to-face engagement that does not in itself resist lateral forces.

Because of the proportions of the body of weldable material, 4 and the quantity of weld 6 provided by the invention, the screw threaded bar 8 is supported so that it can resist the substantial bending forces generated, in use, from the rail.

Because of the way in which it is mounted, the screw-threaded bar 8 can be made of a particularly high strength material that is either not capable of being welded with a full strength weld, or is a material such that the heat of a weld would destroy its strength characteristics.

To match the shear strength of the high strength bar a large area of weld is required. As has been indicated above, it is possible for the weld to extend up 20% or more of the height of the body 4. Also a large cross-sectional area in the body of weldable material is necessary since this can be a lower strength material in relation to the screw-threaded bar. However, since the body and the screw-threaded bar are mainly subject to horizontal forces, the pullout strength of the threads of the body, made from material of inferior strength, is less important. Since the weld is dispersed around the perimeter of the body this is stronger in resisting lateral loading than a same area of weld closer to the centre of the screw-threaded bar.

In the constructional form illustrated the rail anchorage body 12 has an aperture 9 in which is received a rotary cam having a hexagonal head 14 and an eccentric hole through which passes the screw-threaded bar 8. When the cam is rotated by applying a wrench to its head 14 the part of the rail anchorage which abuts the rail flange moves relative to the body 4 and screw-threaded bar 8. In this way the rail anchorage can be tightly fitted against a rail in a variety of lateral positions. With several anchorages fitted along both sides of the rail, the rail alignment can be adjusted and the rail tightly held in position. The invention is particularly suited to such an adjustable rail anchorage since the increase in strength offered by the body 4 and high strength screw-threaded bar 8 allows extra stress to be placed in the bar when a nut 15 on the bar is tightened towards the rail anchorage. This provides increased frictional resistance between the eccentric rotary cam and the rail anchorage body and therefore helps prevent any relative potential movement.

Figure 8:
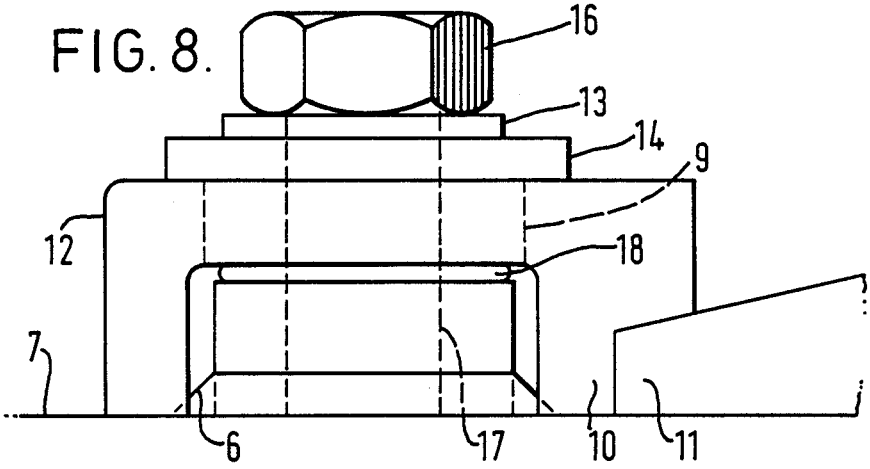
FIG. 8 is a side view similar to FIG. 7 but showing use of alternative components.

To secure a part 10 of the rail anchorage body 12 to a rail flange 11, a washer 13 and the nut 15 just mentioned are placed on the screw-threaded bar 8 and tightened towards the rail anchorage body. This presses the rail anchorage body 12 against the support structure. When forces are transferred from the rail flange 11 to the rail anchorage, the rail is prevented from moving laterally relative to the longitudinal direction of the rail because the anchorage is fastened efficiently to the support structure. The rail anchorage is therefore capable of receiving very large lateral loads relative to its size and the diameter of the screw-threaded bar, as compared with the prior art in which a much larger diameter weldable threaded bar is welded directly to the support structure. As shown in FIG. 8, as an alternative to a screw-threaded bar and nut, a bolt 16 with a screw-threaded shank 17 can be screwed into the body of weldable material and tightened against the rail anchorage.

As shown in FIG. 7, there is a small gap G between the top of the body of weldable material and the underside of the rail anchorage. This may be filled with a protective grease layer and/or a protective compressible washer 18 (as shown in FIG. 8) to protect the threads of the body to allow re-use. The grease layer or compressible washer are best positioned prior to the assembly of the rail anchorage over the body. If the top surface of the body of weldable material and the bottom surface of the rail anchorage are rough this will help adhesion of the grease in the small gap between the two surfaces. Also a recess 5 at the end of the screw threads of the body helps retain the grease and allows penetration into the threads. In the modification of FIGS. 9 and 9A a lip 5A around the outer edge of the top of the body defines a further recess around the recess 5, further to increase grease retention.

It is an important feature of the invention that the body of weldable material can be welded to the support structure and the support structure transported to site. The anchorage can then be assembled on site. Because the screw threads in the body are internal they are protected during transportation of the support structure.

I claim:

1. A rail anchorage arrangement for fastening a rail, the anchorage comprising:

a support structure;

a body of weldable material welded to the upper surface of the support structure at a weld between the body and the support structure extending at least partially around the body and along at least 20% of the length of the body from said upper surface of the support structure;

a screw-threaded hole extending into the body of weldable material from the end thereof remote from said upper surface of the support structure;

a screw-threaded member screwed into the screw-threaded hole so as to be made fast in the body of weldable material, this member not being threaded into the support structure;

a rail anchorage having a hole receiving the screw-threaded member so that the screw-threaded member makes fast the rail anchorage against said upper surface of the support structure to secure a rail to the support structure;

the body having a lateral dimension which is at least 40% greater than the outer dimension of the thread of the screw-threaded member so that the body and the weld serve to resist substantially all lateral forces between the rail anchorage and the support structure.

2. A rail anchorage arrangement according to claim 1 wherein the screw-threaded hole extends into the body of weldable material to said upper surface of the support structure.

3. A rail anchorage arrangement according to claim 2, wherein the end portion of the screw-threaded member adjacent said upper surface of the support structure is within said weld.

4. A rail anchorage arrangement according to claim 1, wherein the rail anchorage and the body of weldable material define there between, when the rail anchorage is secured to the support structure, a gap for receiving means to protect the screw threads of the body of weldable material and the screw-threaded member.

5. A rail anchorage arrangement according to claim 4, wherein said gap is defined in part by a recess at one end of the screw threads in the body of weldable material.

6. A rail anchorage arrangement according to claim 5, wherein said gap is further defined in part by a further recess in the body of weldable material that is around the first-mentioned recess.

7. A rail anchorage arrangement according to claim 1, wherein the screw-threaded member is a screw-threaded bar that receives a nut that secures the rail anchorage to the support structure.

8. A rail anchorage arrangement according to claim 1, wherein the screw-threaded member is a screw-threaded bolt that is tightened down to secure the rail anchorage to the support structure.

9. A rail anchorage arrangement according to claim 1, wherein the rail anchorage is apertured to receive the screw-threaded member and includes a rotary cam which has an eccentric hole through which the screw-threaded member passes, the cam being rotatable to act on the screw-threaded member tightly to fit the anchorage arrangement to a rail.

* * * * *